United States Patent [19]

Morris et al.

[11] Patent Number: 4,774,432

[45] Date of Patent: Sep. 27, 1988

[54] ELECTRIC LAMP WITH FLEXIBLE COVER HOLDER

[75] Inventors: Merle E. Morris, Lexington; Larry R. Fields, Winchester; George B. Kendrick, Lexington, all of Ky.

[73] Assignee: GTE Products Corporation, Danvers, Mass.

[21] Appl. No.: 140,975

[22] Filed: Jan. 6, 1988

Related U.S. Application Data

[63] Continuation of Ser. No. 882,334, Jul. 7, 1986, abandoned.

[51] Int. Cl.[4] ..... H01J 5/16

[52] U.S. Cl. ..... 313/111; 313/113

[58] Field of Search ..... 313/110, 111, 113, 116, 313/25, 578, 579, 315, 317, 318; 362/296, 297, 329, 375

[56] References Cited

U.S. PATENT DOCUMENTS

| | | | |
|---|---|---|---|
| 1,322,044 | 11/1919 | Otte | 362/375 |
| 4,447,862 | 5/1984 | Shanks | 313/113 |
| 4,504,889 | 3/1985 | Goldfarb | 362/329 X |
| 4,595,540 | 7/1986 | Roberts | 313/113 |
| 4,604,679 | 8/1986 | Rolando et al. | 362/296 X |
| 4,674,017 | 6/1987 | Bradley et al. | 362/329 X |
| 4,675,792 | 6/1987 | Dorleans | 313/113 X |

*Primary Examiner*—David K. Moore
*Assistant Examiner*—Michael Horabik
*Attorney, Agent, or Firm*—Lawrence R. Fraley

[57] ABSTRACT

An improved electric lamp wherein a flexible cover holder is utilized to secure the lamp's cover means (e.g., lens) against the reflector in a sealed manner. The holder flexes during lamp operation to enable expansion and/or contraction of the cover means in such a manner that damage thereto is substantially prevented. In one example, a ceramic reflector and glass lens combination was used, with the holder comprising an annular, metallic (e.g., aluminum) rim.

8 Claims, 2 Drawing Sheets

ELECTRIC LAMP WITH FLEXIBLE COVER HOLDER

This application is a continuation, of application Ser. No. 882,334, filed July 7, 1986 now abandoned.

TECHNICAL FIELD

The invention relates to electric lamps and particularly to electric lamps for use in such applications as down lighting, display lighting, flood lighting and track lighting.

BACKGROUND

As is well known, electric lamps have been in existence for several years. With regard to those utilized in the above applications, typically two types are presently being used in the lighting field. One such lamp, referred to in the art as a PAR (parabolic aluminized reflector) type lamp, typically utilizes a glass reflector and separate glass cover in which is positioned a coiled tungsten filament. A base member secured to the reflector is designed for being positioned within the required socket to provide the necessary connection to a power source (e.g., 120 VAC) for lamp operation. Examples of such lamps are illustrated in U.S. Pat. Nos. 4,506,316 (Thiry et al). 4,484,254 (Puckett et al) and 4,473,872 (Puckett et al), all of which are assigned to the same assignee as the instant invention.

A second type of lamp of this variety includes a quartz or high silica glass envelope having therein a coiled tungsten filament and also including a base member located on the envelope, the base designed for being positioned within a socket as mentioned above. Lamps of this type are referred to in the lighting field with such product designations as R20 (the R standing for reflector), R30, R40, ER30 (the ER standing for ellipsoidal reflector) and ER40. Examples of such lamps are illustrated in U.S. Pat. Nos. 4,041,344 (LaGiusa), Re. 30,832 (LaGuisa) and 4,331,901 (Vrijer et al).

DISCLOSURE OF THE INVENTION

It is a primary object of this invention to enhance the electric lamp art by providing an improved electric lamp which possesses the several features described herein, including particularly the provision of a flexible holder capable of positively securing the lamp's cover (e.g., lens) to the reflector in such a manner that the cover can expand and/or contract without damage thereto.

It is another object of this invention to provide such a lamp which can be cost effectively produced on a mass production basis.

In accordance with one aspect of the invention, there is provided an improved electric lamp which includes a reflector having a forward, concave reflecting portion including a forward opening therein, a light source located within the reflector, and a light-transmitting cover means for providing a cover for the reflector's forward opening. The improvement comprises providing a holder member secured to the forward, concave reflecting portion relative to the light-transmitting cover means and engaging the cover means in a flexible manner to enable expansion and contraction of the cover means whereby damage to the cover means caused by this expansion and contraction is substantially prevented.

BEST MODE FOR CARRYING OUT THE INVENTION

For a better understanding of the present invention together with other and further objects, advantages and capabilties thereof, reference is made to the following disclosure and appended claims in connection with the above-described drawings.

Figure 1:
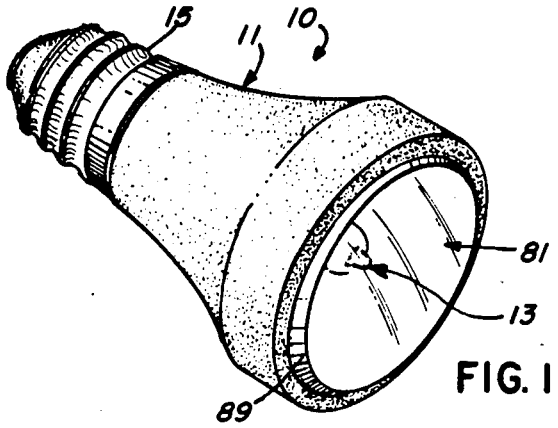
FIG. 1 is a perspective view of one example of an electric lamp including a holder member in accordance with a preferred embodiment of the invention.

With particular attention to FIG. 1, there is shown one example of an electric lamp 10 including a holder member in accordance with a preferred embodiment of the invention. As will be defined herein, lamp 10 is highly efficient and of compact, rugged design. That is, the lamp defined herein is specifically designed for being of relatively small construction while capable of providing light output at levels comparative to the aforementioned, known lamps. It is to be understood, however, that the invention is readily applicable to other types of electric lamps than that described herein and the invention should thus not be limited in scope to this specific lamp.

Figure 2:
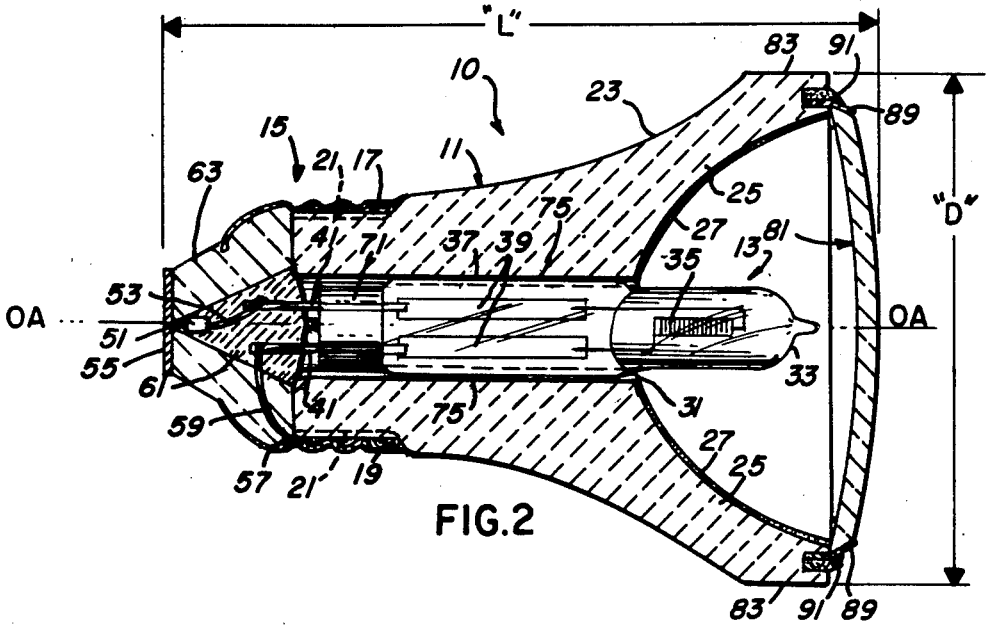
FIG. 2 is an enlarged side elevational view, in section, of the lamp of FIG. 1.

In comparing FIGS. 1 and 2, lamp 10 is shown to include a reflector 11, a light source (i.e., light-emitting capsule 13) located within the reflector, and may also include a base member 15 for being secured to the reflector and adapted for being positioned within an appropriate socket (not shown) which in turn is electrically coupled to a power source (e.g., 120 VAC) for providing electrical energy to the invention. Base member 15, if used, is preferably of substantially similar external configuration to known bases utilized in lamps of the type described herein such that lamp 10 is readily adaptable for use within existing socket constructions. In the example illustrated in the drawings, base member 15 preferably possesses an external configuration similar to existing screw bases similar to those employed in the aforementioned PAR, R, and ER lamps. Other types of bases are also readily capable of being used in the invention, examples including those of the skirted screw, bayonet and end prong variety.

As shown in FIGS. 1 and 2, base member 15 is positioned on an external surface of a rear, protruding neck portion 17 of reflector 11. Assembly (to be further described in FIG. 3 below) is accomplished by sliding the substantially cylindrically shaped base member onto the similarly configured protruding neck portion 17. Fixed securement is accomplished using a quantity of ceramic adhesive 19 or the like material, or, alternatively, may be provided by other means. One such alternative means is a procedure known as magnetic metalforming wherein an electrical coil is located relative to (about)

the base member while the base is positioned on the reflector's neck portion. A pulsed magnetic field is generated from electric current passing through the coil to exert a controllable pressure on the metal base member. High voltage capacitors are discharged through the coil, making this created field extremely intense. The field in turn induces current in the base member, setting up an opposing magnetic field. As a result, high pressures are generated, causing the metallic base to compress and form a tight fit on the reflector's neck.

In the embodiment shown in the drawings, elongated slots 21 (see also FIG. 4) are preferably provided within the reflector's neck portion to accommodate additional quantities of ceramic adhesive and thus provide added securement of base member 15. Alternatively (i.e., using the aforementioned metalforming technique), the neck portion's external surface may be substantially smooth and thus devoid of slots such as depicted in the drawings.

Reflector 11 is preferably of ceramic material and is thus capable of withstanding relatively high temperatures at which lamp 10 is specifically designed for operating. By way of example, the reflector temperature for electric lamp 10 during operation thereof exceeded 250 degrees Celsius and in one instance (wherein capsule 13 operated at 100 watts), the corresponding reflector temperature approached 350 degrees Celsius. The ability to operate at such relatively high temperatures in a safe and facile manner to provide light output at levels similar to those of the aforementioned type lamps constitutes a significant feature of lamp 10, particularly considering the overall compact design thereof. By way of example, lamp 10, in one embodiment, possessed an overall length of only about 2.14 inch (dimension "L" in FIG. 2) and an overall outer diameter of only about 2.00 inch (dimension "D" in FIG. 2).

As specifically shown in FIG. 2, reflector 11 further includes a forward, concave reflecting portion 23 which includes therein the concave reflecting surface 25 designed for reflecting light from capsule 13 during lamp operation. In a preferred embodiment, surface 25 is of substantially parabolic configuration and was glazed during formation of the green ceramic reflector. Surface 25 may also be faceted, fluted, peened or otherwise altered to affect light output. Steatite ceramic powder or other types of ceramic known in the industry, with controlled particle size, is pressed into the desired shape at high pressure to obtain a high density "green" part. Other methods such as slipcasting or molding a wet slurry may also be used. Liquid glaze is applied, preferably by spraying, onto the area containing the desired contour for the reflective surface while the ceramic is spinning in order to achieve a very precise thin coating. The glaze has been formulated such that it may be sintered to obtain a hard smooth surface at the same time and temperature as required for the ceramic to be sintered and fully cured. Optionally, the outside of the ceramic may be glazed with a clear glaze or with colors, surface finishes and patterns as desired for cosmetic purposes. Colorant may also be added to the ceramic bulk material to produce a final product having such a color.

In addition to the aforementioned glazing of the concave reflecting surface of reflector 11, a metallic reflective coating (27) (e.g., vapor deposited high purity aluminum) is added over the glazed surface after sintering for the purpose of enhancing reflectivity.

Reflector 11 also includes a central opening 31 therein which, as illustrated, passes from the concave reflecting portion 23 to the outer extremity of rear, neck portion 17. As will be described, opening 31 is preferably of substantially cylindrical configuration and lies coaxial with the optical axis (OA—OA) of the reflector. Accordingly, the light-emitting capsule is located substantially within this opening such that the bulb portion 33 thereof projects within and is substantially surrounded by the concave reflecting surfaces 25 of the reflector. Capsule 13 is preferably a tungsten halogen capsule. By a tungsten halogen capsule is meant a capsule wherein the bulb portion thereof includes a coiled (or coiled coil) tungsten filament (35) as the light source and an internal atmosphere containing a halogen, such as bromine. Tungsten halogen lamps and lamp capsules are known in the art and operate on a regenerative cycle initiated when a tungsten halide is produced and chemically combines with particles evaporated from the energized filament to thus prevent evaporated tungsten particles from depositing on other filaments (if utilized) or on the envelope wall. Typically, such capsules are constructed of quartz, high silica glass, or aluminosilicate glass. Alternatively, the lamp's light source may comprise an arc discharge capsule of the variety shown and described in U.S. Pat. Nos. 4,302,699 (Keeffe et al), 4,321,504 (Keeffe et al) and 4,454,450 (English et al), all of which are assigned to the assignee of this invention. Such lamps are also referred to as low wattage metal halide arc lamps and include a pair of spaced-apart electrodes which extend within the tube (bulb). An arc is created between the electrodes during lamp operation, which arc serves as the light source.

Capsules of the arc discharge and tungsten halogen variety typically include a press sealed end portion through which pass at least two electrical conductors which in turn project from the end thereof. Unlike capsules known in the art, however, the capsule of lamp 10 includes a press sealed end portion 37 of substantially elongated configuration in comparison to the capsule's bulb portion. By way of example, the capsule envelope in one embodiment possessed an overall length (dimension "CL" in FIG. 3) of about 1.70 inch and a corresponding seal length (dimension "SL" in FIG. 3) of about 1.05 inch. By elongated is thus meant a capsule having a sealed end length within the range of from about thirty percent to about eighty percent of the overall capsule length.

Located within elongated seal end portion 37 is a pair of elongated conductive foils 39 (e.g., molybdenum) which each serve to interconnect an inner and outer lead portion of one of the respective electrical conductors 41 of the invention. In one example, the outer portions of each of these conductors was comprised of molybdenum material while the corresponding inner portion (that coupled to coiled filament 35) were each of tungsten material. Each conductor 41 is in turn electrically coupled to a respective one of the two electrical contact portions of base member 15. As shown in FIG. 2, one conductor 41 is connected to a diode 51 through a conducting wire 53, which diode is in turn electrically connected to the conductive tip contact portion 55 of base member 15. The remaining conductor 41 is connected to the metallic shell contact portion 57 of the base member, preferably by a wire conductor 59. In a preferred example, the first conductor 53 is preferably of copper material and possesses an outer diameter of about 0.030 inch. The second wire conductor 59 was preferably of three parts (only one shown), each of nickel material and butt-welded to form a singular element. The three parts possessed outer diameters of 0.020 inch, 0.006 inch and 0.020 inch, respectively. Wire 59, having this small diameter middle part, thus serves as a fusible element for lamp 10. The outer shell contact portion 57 of base member 15 in one example was of nickel-plated brass, as was the tip contact portion 55. Understandably, solder (not shown) may be utilized in base configurations of this type to provide connections between such elements as disclosed herein.

Preferably, diode 51 is sealed within a quantity of ceramic adhesive 61 or the like which in turn is located within a reservoir portion of electrically insulative material 63 (e.g., glass) which also forms part of base member 15. This ceramic adhesive, which covers the diode, thus serves to insulate this component from heat generated by capsule 13 during lamp operation. In the preferred example, the ceramic adhesive utilized for material 61 was also white in color to thus reflect heat away from the diode. A preferred example of this material is available under the product designation Dylon 07 adhesive, sold by Dylon Industries, Inc., Berea, Ohio 44017.

The purpose of utilizing diode 51 in lamp 10 is to reduce the line voltage. In one example, the aforementioned 120 VAC was reduced to 84 VAC to thus allow a more rugged and efficient tungsten coil. Accordingly, a coil less prone to sag or damage (e.g., during handling) is possible. Potting the diode within the aforementioned white ceramic adhesive, as stated, served to reflect heat from the lamp's capsule away from the diode during lamp operation. In one example, a temperature reduction of from about 330 degrees Celsius to about 220 degrees Celsius (e.g., when utilizing the aforementioned 100 watt capsule) was realized. Because the life of a diode is determined to a large extent on its operating temperature, locating the diode in the manner taught herein (within a depression and as far from bulb portion 33 as possible) assures extended life for both the diode and lamp.

Figure 3:
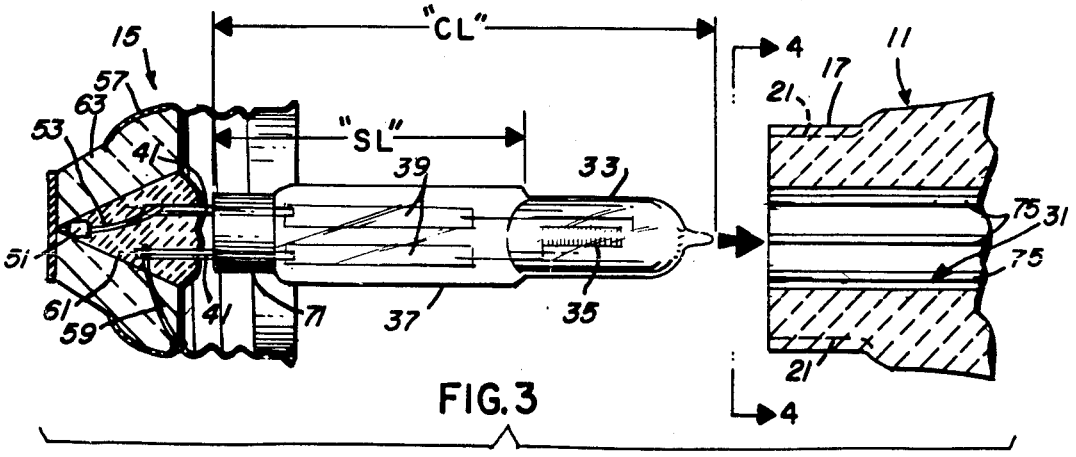
FIG. 3 is an exploded, partial side elevational view of the lamp of FIG. 2, in section, illustrating a technique for positioning the lamp's light-emitting capsule within the ceramic reflector thereof.

In FIGS. 2 and 3, the elongated sealed end portion 37 of capsule 13 is shown to include a protruding end section 71 which is designed for engaging an internal surface of opening 31 within the reflector's neck portion. Such engagement serves to stabilize the capsule's position within reflector 11 (e.g., during jarring as may occur during handling). In addition, it is preferred that the bulb portion of capsule 13 also engage the reflector opening's internal surface, thus providing a dual contact at spaced-apart locations between capsule and reflector. As shown in FIGS. 2 and 3, providing end segment 71 and bulb portion 33 are both of cylindrical configuration, each preferably possessing similar outer diameters. The aforementioned sealed portion 37 is of course of flattened configuration and of a width slightly greater than the corresponding outer diameter for the two capsule parts it joins. The above capsule-reflector contact arrangement thus assures a lamp of more rugged construction. In addition, this spaced-apart means of contact facilitates optical alignment of the capsule's filament structure 35 within reflector 11. During assembly, capsule 13 is secured within the base member 15 in the configuration depicted in FIG. 3. That is, the projecting conductors 41 are secured within the heat insulating ceramic adhesive 61 to provide a somewhat rigid capsule and base assembly. This entire assembly is then slidably positioned within the protruding neck portion 17 of reflector 11, as indicated in FIG. 3. During such positioning, the protruding end section 71 and/or cylindrical bulb portion 33 slidably engage the reflector's internal surfaces while the metallic contact portion 57 of the base slidably engages the exterior surface of neck portion 17. Prior to such engagement, the aforementioned adhesive 19, if utilized, is applied (e.g., located within the respective slots 21, if utilized). The final result of this assembly is a capsule (and internal coil) in fixed, optical alignment within the lamp's reflector.

The aforementioned assembly technique enables the light center length (the distance from the coiled filament, or, alternatively, the arc location, to the respective reflective surfaces) to be precisely established when the capsule is connected to base member 15. The aforementioned optical alignment is thus possible without further manipulation of the capsule after positioning within the reflector. Extending the length of the press sealed end portion 37 of the capsule has also proven to reduce the seal temperature during lamp operation, thereby extending lamp life. That is, major portions of the sealed end are spaced at a greater distance from the hot bulb portion of the capsule. In one example, a reduced seal temperature of about 100 degrees celsius was observed. It is estimated that such substantial reduction in temperature can improve lamp life by a factor of five when the lamp is operated in the temperature ranges (e.g., at 350 degrees celsius) mentioned above.

Figure 4:
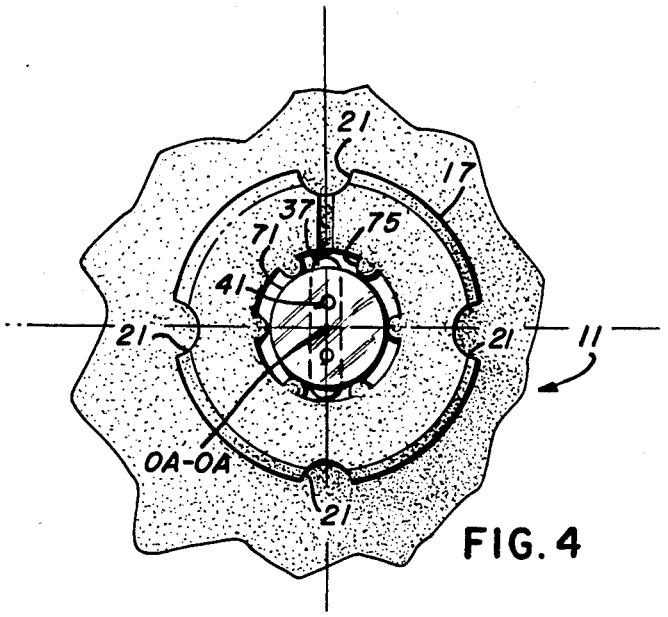
FIG. 4 is a partial end elevational view of the lamp's reflector as taken along the line 4—4 in FIG. 3, the lamp's capsule being shown therein.

Improved (decreased) heat transference between capsule 13 and reflector 11 in the region of sealed end 17 is attained by the provision of a plurality of longitudinal, upstanding projections 75 which extend substantially along the entire length of opening 31. As shown in FIG. 4, a total of six such projections are utilized, these being equally spaced around the reflector's inner surface. As also shown in FIG. 4, the substantially cylindrically shaped protruding end section 71 of capsule 13 engages these projections when the capsule is fully positioned within the reflector's neck portion 17, the larger width, flattened sealed portion 37 extending between respective pairs of opposed projections. In this regard, it is also possible to utilize a protruding and section 71 (and bulb portion, if desired) of different configuration than the one depicted in the drawings. For example, an oblong configuration can be utilized, such that the exterior surfaces thereof engage fewer (e.g., two) than the total number of projections. Such engagement (with at least two projections) is also possible with an end section and/or bulb portion of cylindrical external configuration. In one instance, for example, only one of the two spaced contacting sections (end section 71 or bulb portion 33) contacted only two projections. Ideally, however, both end section 71 and the bulb engage all (six) of the opening's projections 75 (i.e., as depicted in FIG. 4), provided acceptable tolerances are reached. As understood from the above, a relatively close fit may thus exist between capsule and the inner surfaces of opening 31. When engagement is provided between the capsule and projections as shown herein, the amount of heat transferred directly from the capsule to the ceramic material of reflector 11 is considerably reduced. Excessive heat transference in this region can in turn cause a considerable temperature gradient between the reflector's inner and outer regions, which in turn could place undue stress on the ceramic material and cause cracking or other deformities therein. Accordingly, provision of a multiple point type of contact as defined herein between capsule and reflector, which arrangement in turn provides for a corresponding plurality of air passages between these two components, substantially eliminates this potential problem.

The aforementioned point contact relationships between capsule and reflector has also proven advantageous with regard to the reflective coating 27, if utilized in lamp 10. That is, this positioning relationship also served to adequately space the capsule from the coating. It was determined that direct contact between capsule and coating resulted in sublimation of the coating, the result of which was an adverse effect on the reflector's reflecting capability. This was overcome by the positioning relationship described herein.

Figure 5:
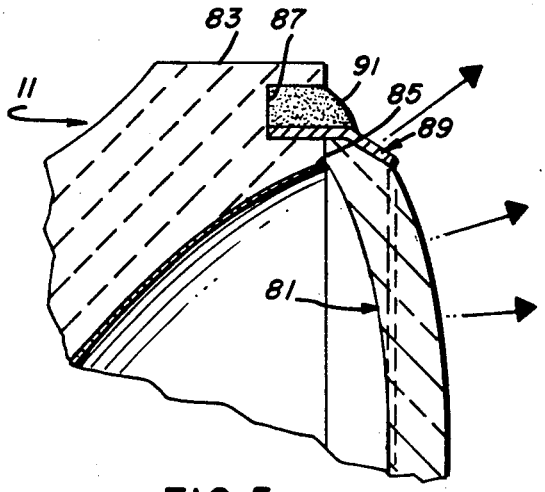
FIG. 5 is an enlarged, partial side elevational view, in section, of the holder member of the invention in accordance with a preferred embodiment thereof.

In accordance with the teachings herein, lamp 10 further includes a light-transmitting cover means 81 which serves to cover the forward opening of the reflector's concave reflecting portion 23 and thus seal the light source therein. Cover means 81 is preferably of transparent glass material (e.g., borosilicate) and is secured against the forwardmost surfaces of the annular rim portion 83 of reflector 11. In one embodiment, cover means 81 comprised a lens which served to direct the light output in a predetermined manner to provide the ultimate pattern desired on the subject area being so illuminated. If so used, this lens will preferably include a stippled internal surface (not shown) for diffusing light passing therethrough, particularly when the reflector's internal reflecting surface is faceted, peened, or similarly altered as mentioned above. As particularly shown in the much enlarged, fragmented view in FIG. 5, the annular shaped cover means abuts against the aforementioned forwardmost surfaces (85). As also shown, this forwardmost portion of the reflector includes an annular groove or slot 87 therein.

Retention of cover means 81 represents a significant feature of the invention and is accomplished by the provision of a holder member 89 which, also being of annular configuration, engages the outer surface of cover means 81 about the periphery thereof. As particularly shown in FIG. 5, holder member 89 is secured within the reflector's groove 87 by a quantity of adhesive 91 (e.g., ceramic adhesive). Holder member 89 is of thin, sound heat conducting metallic material (e.g., aluminum) and, uniquely, is capable of flexing outwardly (as indicated by the directional arrows in FIG. 5) in response to expansion and contraction of the glass cover 81. Such expansion and contraction occurs due to the difference in coefficients of thermal expansion between the ceramic material for reflector 11 and the preferred material (borosilicate glass) for cover 81. By way of specific example, in one embodiment of the invention, the ceramic of reflector 11 possessed a coefficient of thermal expansion of about $8.00\times10^{-6}$ cm./cm./degree Celsius while the borosilicate material of cover means 81 possessed a coefficient of thermal expansion of about $4.00\times10^{-6}$ cm./cm./degree Celsius. The ceramic material thus possesses approximately twice the expansion of the glass material in this example. This is not meant to limit the invention's true scope, however, in that it is also possible to utilize reflector and cover materials possessing closer thermal expansion characteristics. The coefficient of thermal expansion for the ceramic adhesive 91 was about $7.50\times10^{-6}$ cm./cm./degree Celsius. It is thus seen understood that the cover means 81 as defined herein is, surprisingly, not cemented to reflector 11 but instead is effectively secured against the reflector in the abutting, sealed manner defined. This unique ability of the holder to flex during expansion and contraction of the retained cover prevents damage to the cover while still assuring the necessary seal.

There has thus been shown and described a new and unique means of effectively retaining a cover means (e.g., lens) on the forward portion of an electric lamp's reflector. In one example, the holder engages a glass lens against a ceramic reflector to enable expansion and contraction of the lens without damage thereto. Such retention, as defined herein, is possible without use of an adhesive or the like between the cover and reflector to contact both, a requirement in many prior art lamps wherein separate cover and reflector components are sealed together.

While there have been shown and described what are at present considered the referred embodiments of the invention, it will be obvious to those skilled in the art that various changes and modifications may be made therein without departing from the scope of the invention as defined by the appended claims.

What is claimed is:

1. An electric lamp comprising:

a ceramic reflector having a forward concave reflecting portion defining a forward opening;

means forming a groove in said reflector, said groove encircling said forward opening;

a light transmitting glass cover abutting said reflector and disposed over said forward opening, the co-efficient of expansion of the material forming the cover being different than the co-efficient expansion of the material forming the reflector;

flexible holder means disposed in said groove and extending outwardly and forming a flange to retain said cover over said forward opening; and adhesive means disposed in said groove and retaining said holder in said groove, whereby said glass cover is retained over said forward opening without the use of an adhesive between said cover and said reflector.

2. The improvement according to claim 1 wherein said light-transmitting cover is a lens.

3. The improvement according to claim 1 wherein said reflector possesses a coefficient of thermal expansion greater than the coefficient of thermal expansion of said light-transmitting cover.

4. The improvement according to claim 3 wherein said coefficient of thermal expansion of said reflector is about twice said coefficient of thermal expansion of said light-transmitting cover.

5. The improvement according to claim 1 wherein said adhesive means is a ceramic adhesive.

6. The improvement according to claim 1 wherein said holder means is comprised of thin metallic material.

7. The improvement according to claim 1 wherein said metallic material is aluminum.

8. The improvement according to claim 1 wherein said groove and said holder means positioned therein are each of annular configuration.

* * * * *